US009010402B2

(12) United States Patent
Gross

(10) Patent No.: US 9,010,402 B2
(45) Date of Patent: Apr. 21, 2015

(54) METHOD AND APPARATUS FOR INTERLOCKING LOAD CARRYING ELEMENTS

(71) Applicant: National Institute of Standards and Technology, Gaithersburg, MD (US)

(72) Inventor: John L. Gross, Germantown, MD (US)

(73) Assignees: The United States of America as represented by the Secretary of Commerce, Washington, DC (US); The National Institute of Standards and Technology, Gaithersburg, MD (US)

( * ) Notice: Subject to any disclaimer, the term of this patent is extended or adjusted under 35 U.S.C. 154(b) by 0 days.

(21) Appl. No.: 13/891,004

(22) Filed: May 9, 2013

(65) Prior Publication Data

US 2013/0299116 A1 Nov. 14, 2013

Related U.S. Application Data

(60) Provisional application No. 61/644,520, filed on May 9, 2012.

(51) Int. Cl.

| | |
|---|---|
| ***B23K 23/00*** | (2006.01) |
| ***B23K 31/02*** | (2006.01) |
| ***B22D 19/04*** | (2006.01) |

(52) U.S. Cl.

CPC ..... *B22D 19/04* (2013.01)

(58) Field of Classification Search

USPC ..... 164/54, 335; 249/106, 197, 86, 83, 90; 266/167; 228/234.3

See application file for complete search history.

(56) References Cited

U.S. PATENT DOCUMENTS

| | | | | |
|---|---|---|---|---|
| 2,999,124 | A * | 9/1961 | Burke | 174/84 R |
| 3,638,978 | A | 2/1972 | Guntermann | |
| 4,120,440 | A | 10/1978 | Kirkwood et al. | |
| 4,885,452 | A * | 12/1989 | Amos et al. | 219/130.4 |
| 5,259,549 | A | 11/1993 | Loew et al. | |
| 5,753,006 | A | 5/1998 | Eggert et al. | |
| 5,786,296 | A | 7/1998 | Shustorovich et al. | |
| 6,506,338 | B1 | 1/2003 | Gedevanishvili et al. | |
| 6,565,678 | B2 | 5/2003 | Fairchild et al. | |
| 6,642,471 | B2 | 11/2003 | Imai et al. | |
| 7,943,883 | B2 | 5/2011 | Doira et al. | |
| 2007/0034673 | A1 | 2/2007 | Mccrink | |
| 2009/0173873 | A1 * | 7/2009 | Stidham et al. | 249/83 |
| 2009/0294410 | A1 | 12/2009 | Iwase et al. | |

* cited by examiner

*Primary Examiner* — Keith Walker
*Assistant Examiner* — Steven Ha
(74) *Attorney, Agent, or Firm* — Steve Witters; Witters & Associates

(57) ABSTRACT

A method for interlocking structural steel components with a metal-filled interlock is disclosed herein. The method comprises placing a mold about aligned contoured portions of structural steel components and attaching a crucible and a spout to the mold. The crucible is charged with exothermic reactive metals which are ignited, forming a molten metal filler. The molten metal filler melts a metal plug in the crucible or spout and the molten metal filler flows into the mold and about the aligned contoured portions of the structural steel components. Cooling of the molten metal filler forms a metal-filled interlock. Molds for performing the disclosed method are also disclosed herein.

15 Claims, 9 Drawing Sheets

METHOD AND APPARATUS FOR INTERLOCKING LOAD CARRYING ELEMENTS

CROSS-REFERENCE TO RELATED APPLICATIONS

This application claims the benefit of U.S. Provisional Application No. 61/644,520, filed May 9, 2012, entitled "AUTOMATED STEEL CONSTRUCTION USING METAL-FILLED-MECHANICAL CONNECTIONS", which is hereby incorporated by reference.

STATEMENT REGARDING FEDERALLY SPONSORED RESEARCH OR DEVELOPMENT

This work is funded by the National Institute of Standards and Technology under the U.S. Department of Commerce.

FIELD OF THE INVENTION

This invention relates to a method and apparatus for interlocking load carrying elements.

BACKGROUND

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Load carrying elements, such as steel beams and columns, are typically joined by bolting or welding the elements together to transfer a load from one element to another. These typical methods of joining load carrying elements may require excessive time and expense and may not provide a desired joint.

What is needed is a method for joining structural steel components that may overcome at least some of the deficiencies of the prior art.

SUMMARY

In at least one aspect of the present disclosure, a method of interlocking structural steel components with a metal-filled interlock is provided. The method comprises the steps of: aligning a contoured portion of a first structural steel component to overlie a contoured portion of a second structural steel component; placing a mold about the aligned contoured portions of the structural steel components; attaching a crucible and a spout to the mold wherein the crucible and the spout are configured and disposed to provide gravity fluid flow communication between the crucible and the mold, upon attachment of the crucible and the spout; blocking the gravity fluid flow communication between the crucible and the mold with a metal plug; charging the crucible with exothermic reactive metals; igniting the exothermic reactive metals forming a molten metal filler; melting the metal plug; flowing the molten metal filler into the mold and about the aligned contoured portions of the structural steel components; cooling the molten metal filler and forming a metal-filled interlock; removing the crucible and the spout; and removing the mold.

In at least one other aspect of the present disclosure, a mold configured for interlocking structural steel components according to the disclosed method is disclosed, the mold comprises two parts and is configured to surround the aligned contoured portions of the structural steel components.

In at least one additional aspect of the present disclosure, a mold configured for interlocking structural steel components according to the disclosed method is disclosed, the mold comprises two parts wherein each part has a flange configured to cover a portion of the outer surfaces of first and second structural steel components for providing a time sufficient for the cooling of a molten metal filler to a temperature sufficient to substantially resist flow.

BRIEF DESCRIPTIONS OF THE DRAWINGS

The following figures, which are idealized, are not to scale and are intended to be merely illustrative and non-limiting.

DETAILED DESCRIPTION

A detailed description will now be provided. Each of the appended claims is to be recognized as including equivalents to the various elements or limitations specified in the claims. Depending on the context, all references below to the "invention" or disclosure may in some cases refer to certain specific aspects only. In other cases it will be recognized that references to the "invention" will refer to subject matter recited in one or more, but not necessarily all, of the claims. Each of the inventions is described in greater detail below, including specific aspects, versions and examples, but the disclosure is not limited to these aspects, versions or examples, which are included to enable a person having ordinary skill in the art to make and use the inventions when the information in this patent is combined with available information and technology.

Various terms are as used herein. To the extent a term used in a claim is not defined herein, it should be given the broadest definition persons in the pertinent art have given that term as reflected in printed publications and issued patents at the time of filing. Additionally, unless otherwise specified, all compounds or examples described herein may be substituted or unsubstituted and the listing of compounds or examples includes derivatives thereof. Further, various ranges and/or numerical limitations may be expressly stated below. It should be recognized that unless stated otherwise, it is intended that endpoints are to be interchangeable and any ranges shall include iterative ranges falling within the expressly stated ranges or limitations.

Figure 1:
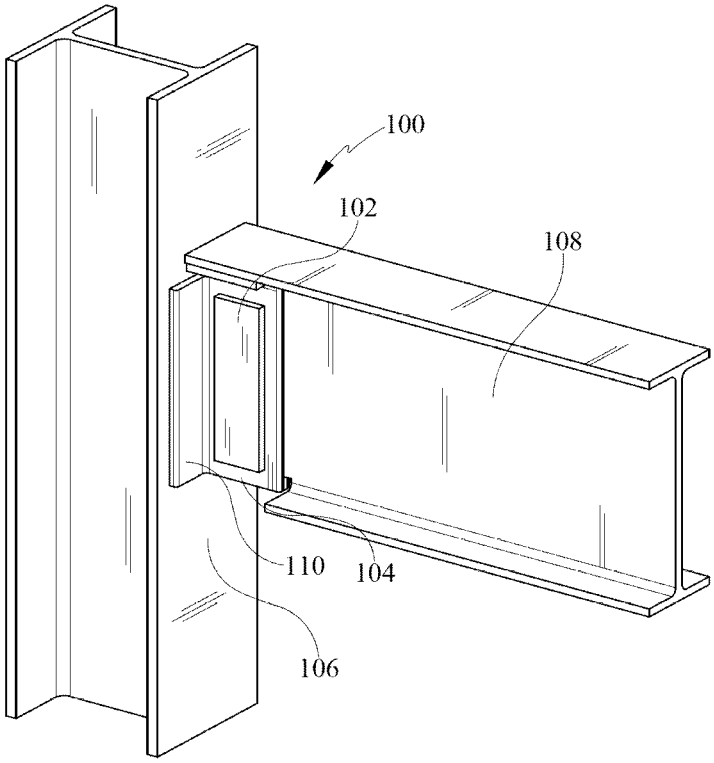
FIG. 1 is a schematic representation of structural steel components interlocked with the method of the present disclosure.

Referring now to the figures, FIG. 1 shows interlocked structural steel components 100. First structural steel component 108 is interlocked with second steel structural component 110 using the method of interlocking structural components with a metal-filled interlock disclosed herein. Steel component 106 has second steel structural component 110 joined thereto. Steel component 106 may be joined to second steel structural component 110 by the presently disclosed method or by other methods of joining steel components as are known in the art. For example, steel component 106 may be welded or bolted to second structural component 110.

Second structural steel component 110 has a contoured portion 104 configured and aligned and disposed for interlocking to first structural steel component 108. In the embodiment shown here, contoured portion 104 comprises a plurality of holes. Metal-filled interlock 102 extends through the plurality of holes in first structural steel component 108 and the plurality of holes in second structural steel support 110. Metal-filled interlock 102 has a rectangular head at each end thereof and the heads have a larger perimeter than the holes in contoured portion 104 of second structural steel support 110. This configuration of a metal-filled interlock 102 prevents metal-filled interlock 102 from being removed from first and second structural steel components 108 and 110.

Metal-filled interlock 102 may be unitary and formed about and/or within first and second structural steel components 108 and 110. In at least one embodiment, metal-filled interlock 102 is not welded or fused with first and second structural steel components 108 and 110. In at least one other embodiment, metal-filled interlock 102 is configured and disposed to provide a resistance to a shear stress placed thereon with a load placed on first structural steel component 108 and second steel structural component 110.

Figure 2:
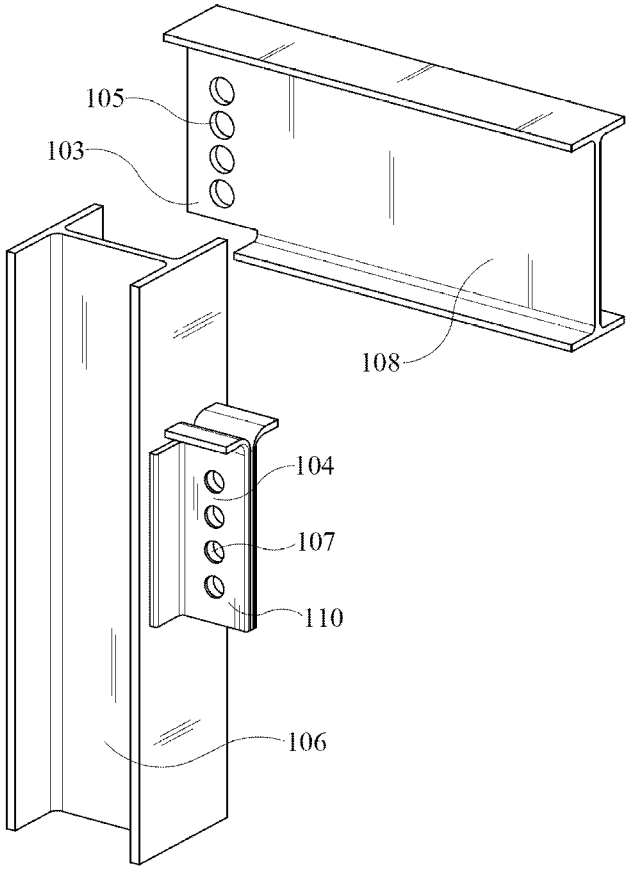
FIG. 2 is a schematic representation of structural steel components having contoured portions to be aligned according the method of the present disclosure.

FIG. 2 shows first and second structural steel components 108 and 110 disposed to be aligned according with the presently disclosed method of interlocking structural steel components with a metal-filled interlock. First structural steel component 108 has contoured portion 103 disposed to be aligned with contoured portion 104 of second structural steel component 110. Contour portions 103 and 104 may have holes 105 and 107, grooves, slots, and other configurations for forming molten metal reservoirs in structural steel components 108 and 110. Steel component 106 may have second structural component 110 attached thereto. Structural steel components 108 and 110 may be channels or beams, as shown in the example in the figures, or may be angles, hollow structural sections, plates, I shaped members, and other configurations of structural steel components as are known in the art.

Figure 3:
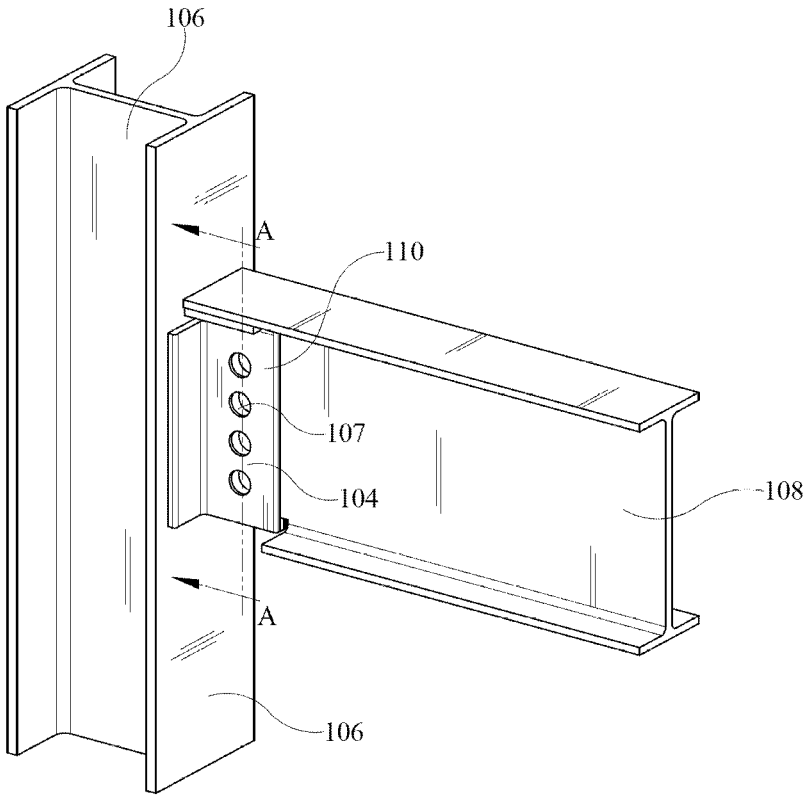
FIG. 3 is a schematic representation of structural steel components having contoured portions aligned according the method of the present disclosure.

FIG. 3 shows first and second structural steel components 108 and 110 aligned according with the presently disclosed method of interlocking structural steel components with a metal-filled interlock. First structural steel component 108 has contoured portion 103 aligned with and overlying contoured portion 104 of second structural steel component 110. Contour portions 103 and 104 have holes 105 and 107 aligned in each of the structural steel components to be in fluid flow communication with one another.

Figure 4:
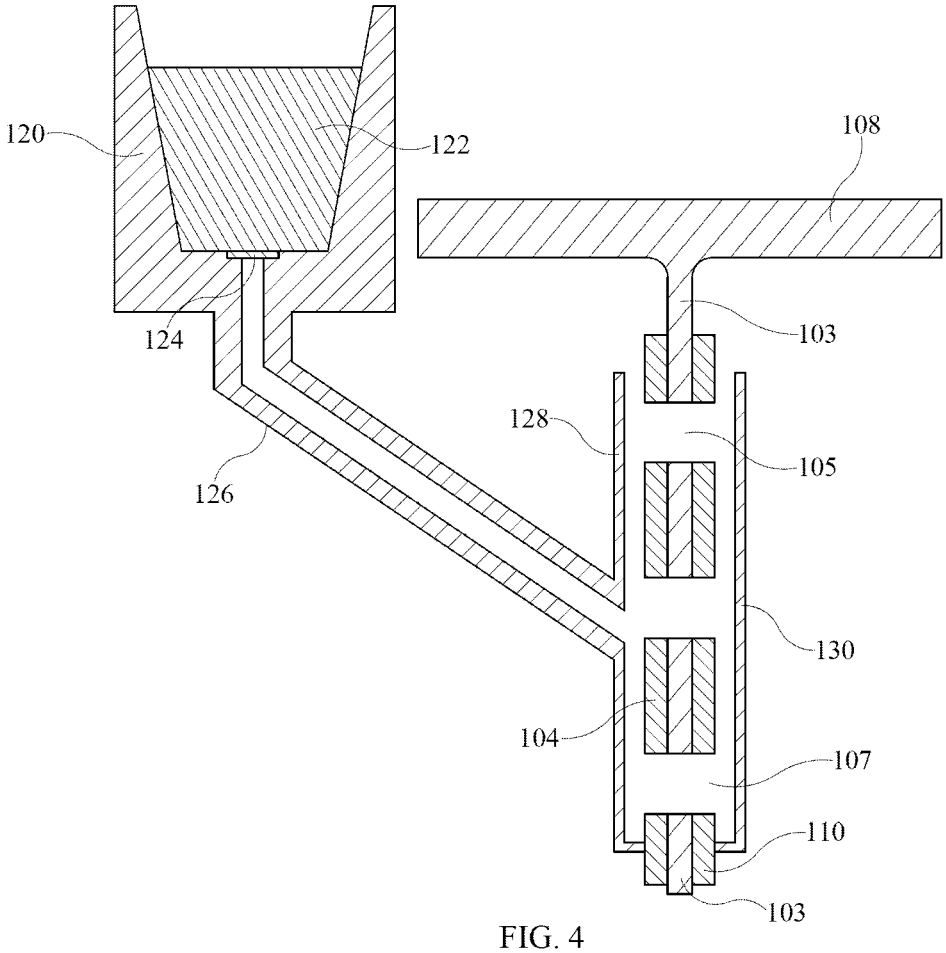
FIG. 4 shows a cross-sectional representation of the aligned contoured portions of FIG. 3 and a system for interlocking the structural steel components according the method of the present disclosure.

FIG. 4 shows a cross-sectional view of the aligned portions of first and second structural steel components 108 and 110, taken along A-A of FIG. 3, and a system for interlocking structural steel components 108 and 110. The system for interlocking structural steel components comprises mold parts 128 and 130, crucible 120, and spout 126. Mold parts 128 and 130 may be configured and disposed to surround aligned contoured portions 103 and 104 of structural steel components 108 and 110 and to join together and hold molten metal filler. Crucible 120 and spout 126 art attached to mold parts 128 and 130 and are configured and disposed to provide gravity fluid flow communication between crucible 120 and mold parts 128 and 130. Metal plug 124 is disposed in crucible 120, or spout 126, and is configured to block the gravity fluid communication between crucible 120 and mold parts 128 and 130. Metal plug 124 is configured to melt, dissolve, or otherwise open the gravity fluid communication between crucible 120 and mold parts 128 and 130 upon reaching a temperature below a temperature reached with a reaction of exothermic reactive metals 122.

Crucible 120 is charged with exothermic reactive metals 122. Exothermic reactive metals 122 may comprise one or more oxidizers such as boron(III) oxide, silicon(IV) oxide, chromium(III) oxide, manganese(IV) oxide, iron(III) oxide, iron(II,III) oxide, copper(II) oxide, and lead(II,IV) oxide. Exothermic reactive metals 122 may comprise one or more of iron, aluminum, carbon, manganese, chromium, vanadium, molybdaenum, nickel, tungsten, silver, silicon, cobalt, magnesium, boron, copper, lead, and cerium. Exothermic reactive metals 122 may comprise a variety of oxidizers and other elements for forming a metal-filled interlock comprising a desired alloy. In at least one aspect of the present disclosure, crucible 120 is charged with iron oxide. In at least one other aspect of the present disclosure, crucible 120 is charged with iron oxide and alumina.

Figure 5:
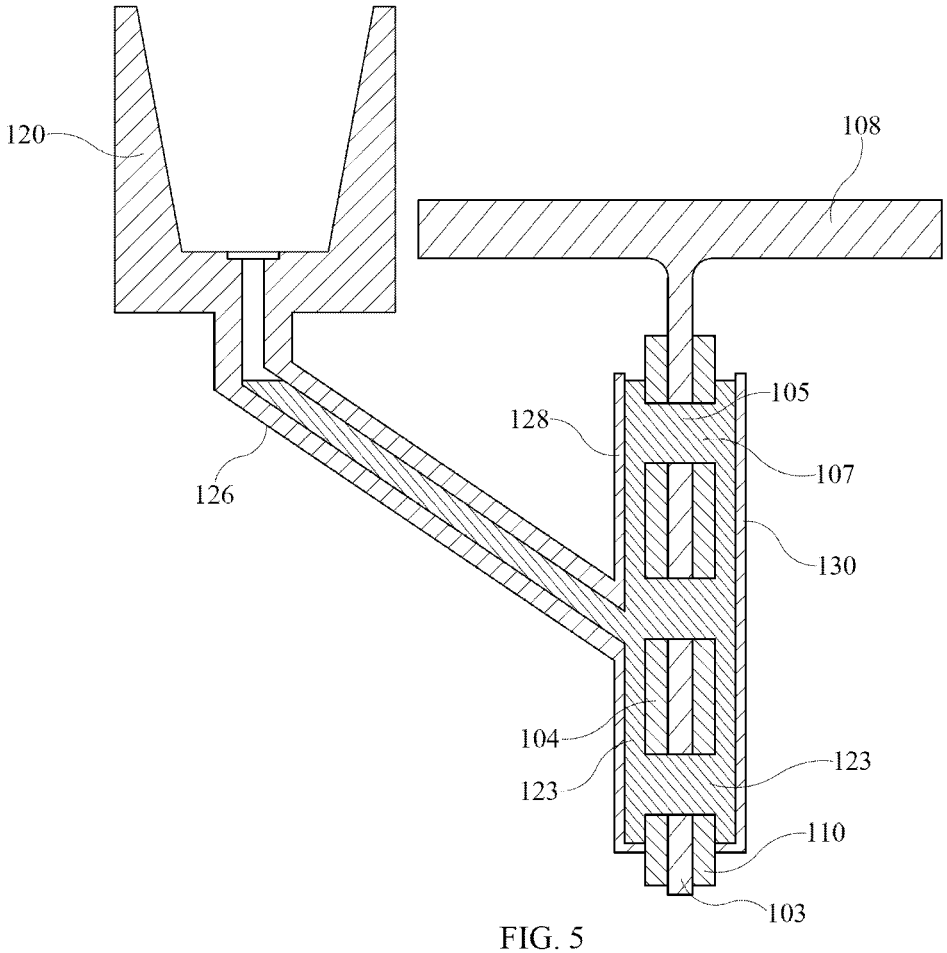
FIG. 5 shows the representation of FIG. 4 after interlocking the structural steel components according the method of the present disclosure.

FIG. 5 shows first structural steel component 108 having contoured portion 103 interlocked with contoured portion 104 of second structural steel component 110. Exothermic reactive metals 122 were ignited to cause an exothermic reaction to form a molten metal filler 123. Molten metal filler 123 reached a temperature sufficient to melt metal plug 124 and open the gravity fluid communication between crucible 120 and mold parts 128 and 130. Molten metal filler 123 flowed, by gravity, out of crucible 120, through spout 126, and into mold parts 128 and 130. Molten metal filler 123 flowed through holes 105 and 107 and cooled to form a metal-filled interlock, interlocking first structural steel component 108 with second structural steel component 110.

Figure 6:
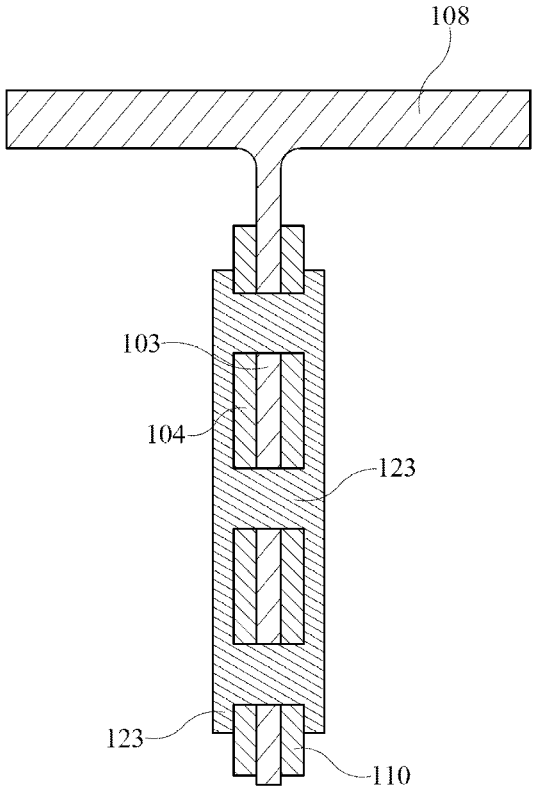
FIG. 6 shows the representation the interlocked structural steel components of FIG. 5 after removing the crucible, mold, and spout according the method of the present disclosure.

FIG. 6 shows an interlock comprising cooled molten metal filler 123 and interlocking first structural steel component 108 with second structural steel component 110. Molten metal filler 123 has cooled for at least a time sufficient for the metal filler 123 to substantially resist fluid flow. Upon cooling, mold parts 128 and 130, crucible 120, and spout 126 were removed.

Figure 7:
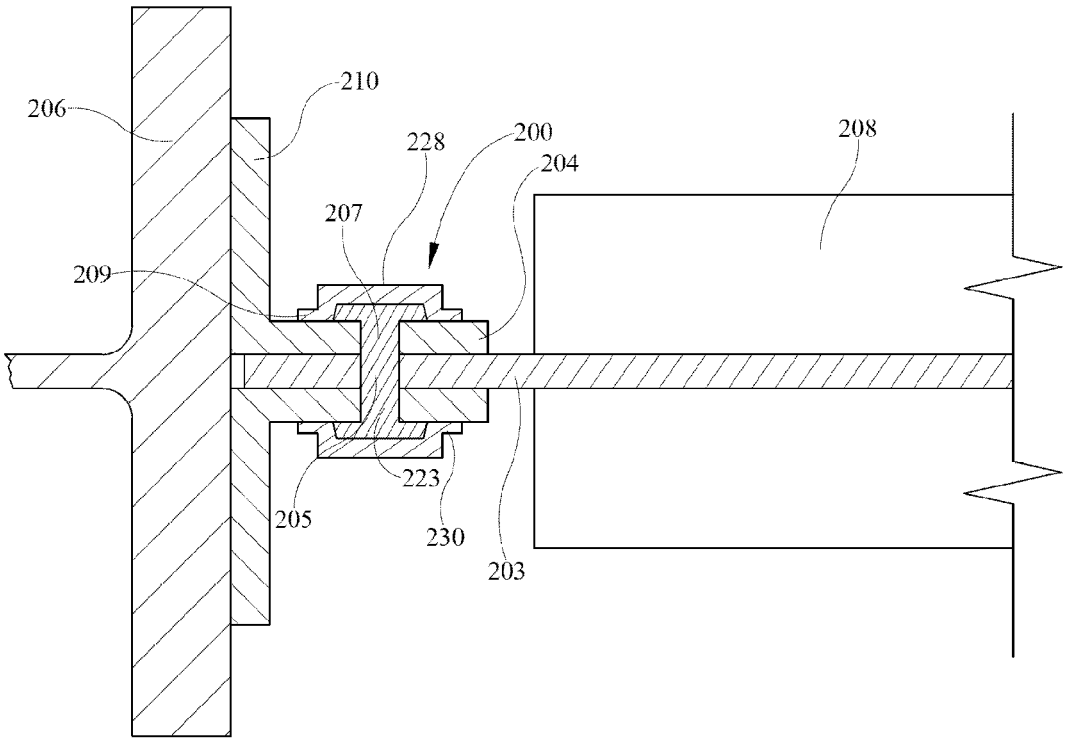
FIG. 7 is a schematic representation of structural steel components interlocked with the method of the present disclosure before removal of molds.

FIG. 7 shows interlocked structural steel components 200. First structural steel component 208 is interlocked with second steel structural component 210 using the method of interlocking structural components with a metal-filled interlock disclosed herein. Steel component 206 has second steel structural component 210 joined thereto. First structural steel component 208 having contoured portion 203 is interlocked with contoured portion 204 of second structural steel component 210. Exothermic reactive metals were ignited to cause an exothermic reaction to form a molten metal filler 223. Molten metal filler 223 flowed into mold parts 228 and 230. Molten metal filler 223 flowed through holes 205 and 207 and cooled to form a metal-filled interlock, interlocking first structural steel component 208 with second structural steel component 210.

First and the second mold parts 228 and 230 are configured and disposed to entirely cover aligned holes 205 and 207 and a portion of the outer surfaces of first and second steel structural components 208 and 210. Mold parts 228 and 230 each have a flange 209 configured to cover a portion of the outer surfaces of first and the second structural steel components 208 and 210 for providing a time sufficient for the cooling of molten metal filler 223 to a temperature sufficient to substantially resist flow.

Figure 8:
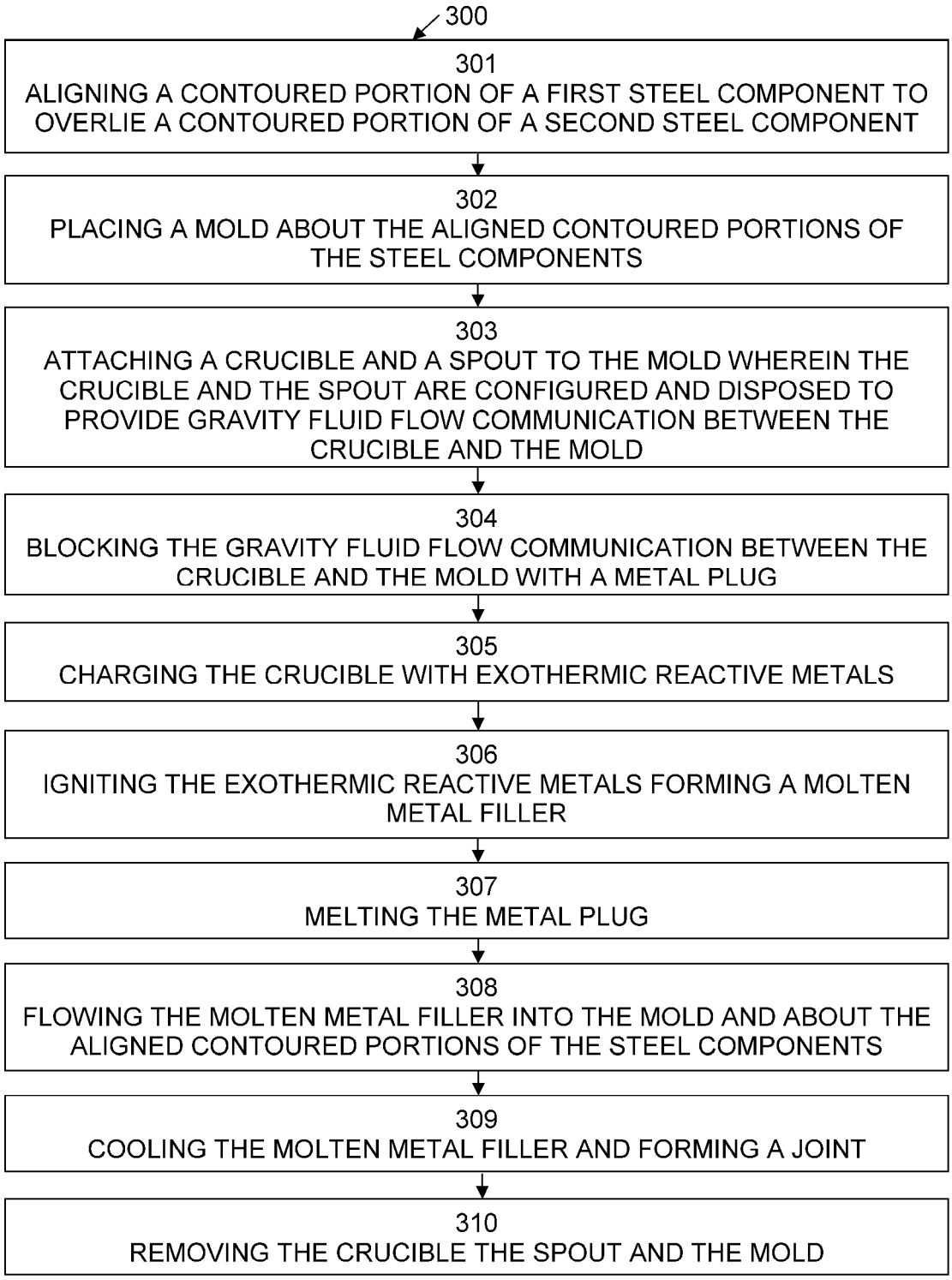
FIG. 8 is a schematic representation of method steps of the present disclosure for interlocking structural steel components.

FIG. 8 schematically shows method 300 for interlocking structural steel components with a metal-filled interlock. Aligning of a contoured portion of a first structural steel component to overlie a contoured portion of a second structural steel component is carried out at step 301. The placing of a mold about the aligned contoured portions of the structural steel components is performed at step 302. After placement of the mold, attaching of a crucible and a spout to the mold wherein the crucible and the spout are configured and disposed to provide gravity fluid flow communication between the crucible and the mold, upon attachment of the crucible and the spout is carried out at step 303. Step 304 comprises blocking the gravity fluid flow communication between the crucible and the mold with a metal plug. The crucible is then charged with exothermic reactive metals at step 305. Igniting of the exothermic reactive metals forming a molten metal filler at step 306 causes the melting of the metal plug at step 307. Flowing the molten metal filler into the mold and about the aligned contoured portions of the structural steel components is performed at step 308. Cooling of the molten metal filler and forming a metal-filled interlock is carried out at step 309. Method 300 ends with the step of removing the crucible, the spout, and the mold at step 310.

EXAMPLES

The present invention may be further illustrated by the following examples, but the particular materials and amounts thereof recited in these examples, as well as other conditions, such as temperatures, and details, should not be construed to unduly limit this invention.

The following examples may provide for interlocking structural steel components with a metal-filled interlock. Three sets of structural steel components were interlocked by performing method 300, shown in FIG. 8. A first set of structural steel components had three aligned 3/16 inch diameter holes and were interlocked with an iron metal filler. A second set of structural steel components had three aligned 3/16 inch diameter holes and were interlocked with a copper metal filler. A third set of structural steel components had three aligned 1⅛ inch diameter holes and were interlocked with a copper metal filler.

Figure 9:
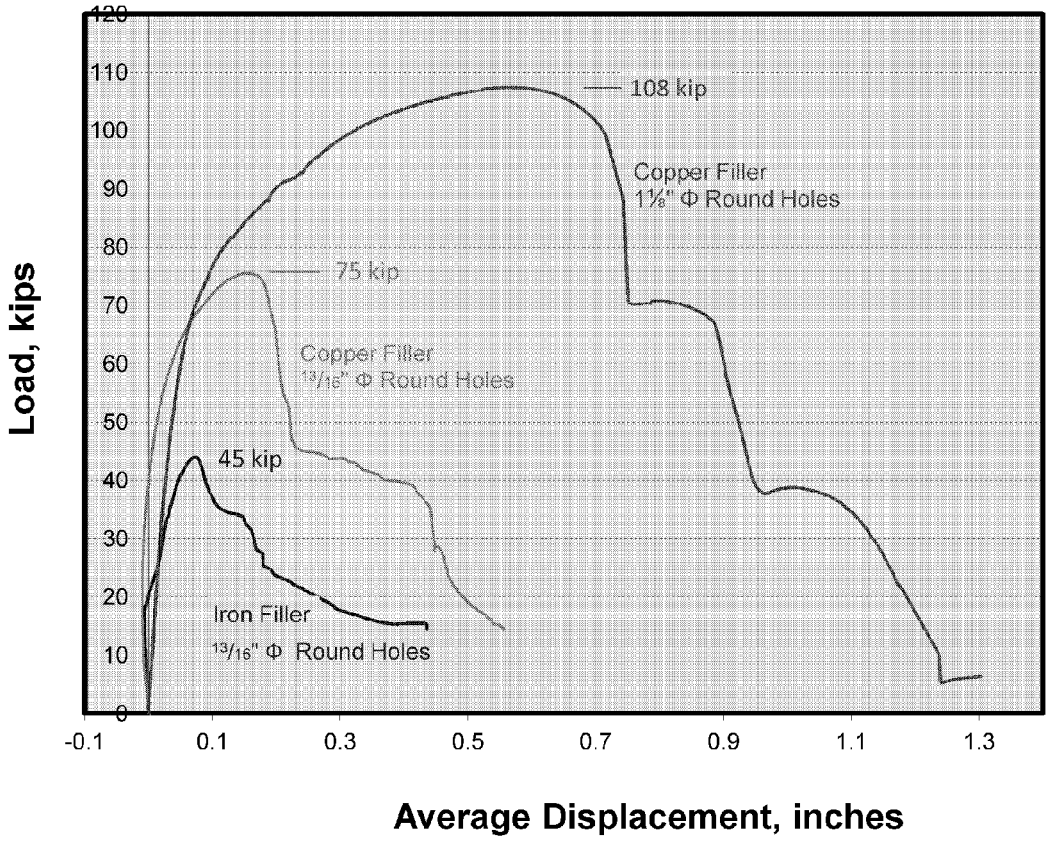
FIG. 9 graphically shows performance data of structural steel components interlocked with the method of the present disclosure.

A load was placed on each set of structural components to transfers a shear stress to each metal-filled interlock and the displacement of each was measured. FIG. 9 graphically shows performance data of each of the three interlocks. The first interlock, interlocking the first set of structural components, held a maximum load of 45 kips (kip=1,000 pounds-force). The second interlock, interlocking the second set of structural components, held a maximum load of 75 kips. The third interlock, interlocking the third set of structural components, held a maximum load of 108 kips.

In view of this disclosure, it will be seen that technologies are generally described for method of interlocking structural steel components with a metal-filled interlock. Additional or other aspects of the present disclosure may be realized by persons having ordinary skill in the art upon reading the present disclosure.

One feature or aspect of an aspect is believed at the time of the filing of this patent application to possibly reside broadly in charging the crucible with aluminothermic reactive metals wherein upon ignition, aluminothermic reactions may take place. Aluminothermic reactions are exothermic chemical reactions using aluminium as the reducing agent at high temperature. For example, charging the crucible with aluminium and iron oxides may cause a thermite reaction between aluminium and iron oxides:

$$Fe_2O_3+2Al \rightarrow 2Fe+Al_2O_3$$

The aluminothermic reaction may be carried out in the crucible, in accordance with the method disclosed herein, for forming interlocks comprising ferroalloys, for example ferroniobium from niobium pentoxide. Interlocks comprising other metals and alloys may be produced in with the method disclosed herein.

Another feature or aspect of an aspect is believed at the time of the filing of this patent application to possibly reside broadly in a method of joining load carrying elements of hot rolled steel sections such as flanges and webs. The method comprises placing or drilling holes, grooves, slots, or other formations in portions of steel sections to be joined. Aligning the portions of the steel sections to be joined and placing a mold about the aligned portions. Filling a crucible with iron oxide and alumina, filler material, and placing the crucible in flow communication with the mold. Igniting the filler material to start an exothermic reaction of the iron oxide and alumina in the crucible. Flowing molten iron and aluminum oxide into the mold from the crucible. Hardening and cooling the molten iron and aluminum oxide in the mold. Finally, removing the mold from the joined portions of load carrying elements.

In an additional aspect, the molten metal filler may separate into component metals and some of the separated metals may substantially remain the spout or crucible thereby flowing only a selected metals into the mold. For example, in an aspect wherein the crucible is charged with iron and aluminum, most or substantially all of the aluminum may remain in the spout and the formed interlock may be primarily iron.

Yet another feature or aspect of an aspect is believed at the time of the filing of this patent application to possibly reside broadly in a method for joining of load carrying elements of hot rolled steel sections (flanges and webs) using molten metal to fill a void between load transfer components. Holes, grooves, slots, etc. may be cut in these load transfer components so that the metal filler when cool provides a mechanical interlock through shear transfer. The molten filler metal may be provided by the exothermic reaction of iron oxide and alumina (filler material) producing molten iron and aluminum oxide precipitate. This process may not involve human intervention except the attachment and charging of a crucible. Various geometries of joined components and formulations of filler metals may be used in various aspects of the present disclosure.

Still another feature or aspect of an aspect is believed at the time of the filing of this patent application to possibly reside broadly in a method for joining structural steel components by metal filling most any geometric configuration of voids formed by the joining of structural steel connections in a variety of construction applications. For example, holes, grooves, slots, and other reservoir designs in which molten filler metal may collect to provide mechanical interlocks through sheer force transfer may be used in the presently disclosed method.

A further feature or aspect of an aspect is believed at the time of the filing of this patent application to possibly reside broadly in a method of joining structural steel members using a metal-filled mechanical interlock which may substantially reduce the time and manpower traditionally involved in completing either bolted or welded connections of structural steel members. Aspects of the present disclosure may realize an increase in the reliability of the connection and a reduction or even an elimination of the need for inspection. Such savings may substantially reduce the cost of a structural steel frame system.

Another feature or aspect of an aspect is believed at the time of the filing of this patent application to possibly reside broadly in automated steel construction using metal-filled mechanical connections. For example, the filler material may be ignited at the end of a daily shift and the crucible may be removed the next morning leaving a completed joint.

Yet another feature or aspect of an aspect is believed at the time of the filing of this patent application to possibly reside broadly in a method for forming metal-interlock connections at substantially less cost than traditional methods. For example, it has been reported that roughly 50% of the cost of steel construction is in the connections including design, shop fabrication, field installation, and inspection. The traditional operations of field bolting and welding are labor intensive, subject to operator skill and weather conditions, and are difficult to inspect. The method of using a metal-filled interlock to transfer forces of the present disclosure may reduce the cost of steel construction while increasing the reliability of connections.

Still another feature or aspect of an aspect is believed at the time of the filing of this patent application to possibly reside broadly in an automated field method of joining members of a structural steel system which requires little or no human intervention, is highly reliable, and accommodates fabrication and alignment tolerances.

A further feature or aspect of an aspect is believed at the time of the filing of this patent application to possibly reside broadly in a method of using a metal-filled interlocks to join structural components that reduces structural steel construction time, reduces worker exposure to fall hazards, accommodates construction out-of-tolerance, reduces inspection requirements, improves reliability, eliminates "banging bolt" problems, and/or eases setting or aligning beams.

SUMMARY OF REFERENCE NUMERALS

100 Interlocked structural steel components
102 Metal-filled interlock
103 Contoured portion of a first structural steel component
104 Contoured portion of a second structural steel component
105 Hole in contoured portion of the first structural steel component
106 Steel component
107 Hole in contoured portion of the second structural steel component
108 First structural steel component
110 Second structural steel component
120 Crucible
122 Exothermic reactive metals
123 Reacted metals
124 Plug
126 Spout
128 Mold portion
130 Mold Portion
200 Interlocked structural steel components
203 Contoured portion of a first structural steel component
204 Contoured portion of a second structural steel component
205 Hole in contoured portion of the first structural steel component
206 Steel component
207 Hole in contoured portion of the second structural steel component
208 First structural steel component
209 Mold flange
210 Second structural steel component
223 Reacted metals
228 Mold portion
230 Mold Portion
300 Process
301-310 Process steps
A Cross-sectional line of the first and second structural components

The invention claimed is:

1. A method of interlocking structural steel components with a metal-filled interlock comprising the steps of:

aligning a contoured portion comprising at least one hole of a first structural steel component to be in flow communication with a contoured portion comprising at least one hole of a second structural steel component;

placing a mold about the aligned contoured portions of the structural steel components and a portion of the outer surfaces of the first and the second structural steel components;

attaching a crucible and a spout to the mold wherein the crucible and the spout are configured and disposed to provide gravity fluid flow communication between the crucible and the mold, upon attachment of the crucible and the spout;

blocking the gravity fluid flow communication between the crucible and the mold with a metal plug;

charging the crucible with exothermic reactive metals;

igniting the exothermic reactive metals forming a molten metal filler;

melting the metal plug;

flowing the molten metal filler into the mold, through the aligned holes, and about the aligned contoured portions of the structural steel components;

forming a molten metal reservoir extending through the contoured portions of structural steel components and onto opposing outside surfaces of the structural steel components;

cooling the molten metal filler and forming a metal-filled interlock;

removing the crucible and the spout; and removing the mold.

2. The method of claim 1 wherein the step of aligning contoured portions of the structural steel components comprises disposing the structural steel components wherein upon a load being placed thereon transfers a shear stress to the metal-filled interlock and the metal-filled interlock is configured and disposed to provide a resistance to the shear stress.

3. The method of claim 1 wherein the contoured portions of the structural steel components further comprise at least one of grooves, slots, and other configurations for forming molten metal reservoirs in the structural steel components upon the step of flowing the molten metal filler into the mold.

4. The method of claim 1 wherein the step of charging the crucible with exothermic reactive metals comprises charging the crucible with iron oxide.

5. The method of claim 4 wherein the step of charging the crucible with exothermic reactive metals comprises charging the crucible with alumina.

6. The method of claim 1 wherein the step of charging the crucible with exothermic reactive metals comprises charging the crucible with at least one of iron, aluminum, carbon, manganese, chromium, vanadium, molybdaenum, nickel, tungsten, silver, silicon, cobalt, magnesium, boron, copper, lead, and cerium.

7. The method of claim 1 wherein the step of charging the crucible with exothermic reactive metals comprises charging the crucible with an oxidizer selected from the group consisting of boron(III) oxide, silicon(IV) oxide, chromium(III) oxide, manganese(IV) oxide, iron(III) oxide, iron(II,III) oxide, copper(II) oxide, and lead(II,IV) oxide.

8. The method of claim 4 wherein the step of flowing the molten metal filler into the mold and about the aligned contoured portions of the structural steel components comprises flowing molten iron.

9. The method of claim 1 wherein the step of placing a mold about the aligned contoured portions of the structural steel components comprises placing the mold to surround the aligned contoured portions of the structural steel components.

10. The method of claim 1 wherein the step of placing a mold about the aligned contoured portions of the structural steel components comprises placing a first mold part on an outer surface of the aligned contoured portion of a first structural steel component and placing a second mold part on an outer surface of the aligned contoured portion of a second structural steel component, wherein the outer surface of the first and second structural steel components are outwardly disposed with respect to the other of the first or second structural steel component.

11. The method of claim 10 wherein the step of placing a mold about the aligned contoured portions of the structural steel components and a portion of the outer surfaces of the first and the second structural steel components comprises placing the first and the second mold parts to entirely cover the aligned holes and a portion of the outer surfaces of the first and the second structural steel components completely surrounding the aligned holes.

12. The method of claim 1 wherein the step of cooling the molten metal filler comprises cooling for a time sufficient for the metal filler to substantially resist fluid flow, prior to the steps of removing the crucible and the spout and removing the mold.

13. The method of claim 1 wherein the structural steel components are selected from the group consisting of channels, beams, angles, hollow structural sections, plates, I shaped members, and combinations thereof.

14. The method of claim 1 further comprising a step of maintaining the structural steel components below their melting, welding, or fusing temperature.

15. The method of claim 1 wherein the step of aligning a contoured portion comprising at least one hole of a first structural steel component to be in flow communication with a contoured portion comprising at least one hole of a second structural steel component further comprises contacting portions of the first and second structural steel component surrounding the holes.

* * * * *